US005531192A

United States Patent [19]

Feucht et al.

[11] Patent Number: 5,531,192

[45] Date of Patent: Jul. 2, 1996

[54] HYDRAULICALLY ACTUATED VALVE SYSTEM

[75] Inventors: Dennis D. Feucht, Morton; Steven J. Funke, Peoria; Steven F. Meister, Chillicothe, all of Ill.

[73] Assignee: Caterpillar Inc., Peoria, Ill.

[21] Appl. No.: 286,068

[22] Filed: Aug. 4, 1994

[51] Int. Cl.[6] ..... F01L 9/02

[52] U.S. Cl. ..... 123/90.12; 123/90.15; 123/90.22; 123/90.49

[58] Field of Search ..... 123/90.12, 90.13, 123/90.11, 90.15, 90.22, 90.48, 90.49

[56] References Cited

U.S. PATENT DOCUMENTS

| | | | |
|---|---|---|---|
| 4,930,464 | 6/1990 | Letsche | 123/90.12 |
| 5,255,641 | 10/1993 | Schechter | 123/90.15 |
| 5,275,136 | 1/1994 | Schechter et al. | 123/90.12 |

OTHER PUBLICATIONS

U.S. patent application, application No. 08/092,373, filed Jul. 15, 1993, "Recuperative Engine Valve System and Method of Operation", J. R. Weber.

U.S. patent application, application No. 08/244,338, filed Nov. 29, 1991, "Engine Valve Seating Velocity Hydraulic Snubber", J. R. Weber.

*Primary Examiner*—Andrew M. Dolinar
*Assistant Examiner*—Weilun Lo
*Attorney, Agent, or Firm*—Diana L. Charlton

[57] ABSTRACT

The design and construction of current electronically-controlled hydraulically-actuated engine valve systems are currently still being tested for dependability. The electronics control various activities including actuation velocity and, therefore, can include complicated components. The present invention overcomes this and other problems by providing a valve actuation system including an electronically-controlled hydraulically-actuated plunger for actuating an engine valve. Hydraulic means are utilized for reducing the plunger velocity thereby controlling the valve lift and the valve seating as the valve approaches the open and closed positions. The hydraulic means reduces the need for a complicated electronic control unit, therefore, improving the feasibility and dependability of the present invention.

34 Claims, 4 Drawing Sheets

HYDRAULICALLY ACTUATED VALVE SYSTEM

TECHNICAL FIELD

This invention relates generally to a valve actuation system for an internal combustion engine and more particularly to an electronically controlled-hydraulically actuated valve system which significantly simplifies the electronic controls normally associated with hydraulically actuated valves by utilizing hydraulic means for controlling the velocity of the actuation system at specific intervals.

BACKGROUND ART

Electro-hydraulically actuated engine valves are advantageous over mechanically actuated engine valves because they are capable of varying, and thereby, optimizing the timing of engine valve opening and closing events in rapid response to varying engine operating conditions.

Recent electro-hydraulic actuation systems utilize advanced electronic control systems which control the initial and terminal velocity when the valve approaches the open or closed positions. However, most advanced electronic control systems are in varying stages of development and are, therefore, not feasible for internal combustion engines currently in production. Additionally, without proven results, the costs and complexity of the advanced electronic control systems may exceed the benefits of such a system.

The present invention utilizes a hydraulic means for controlling the velocity of the valve during its approach toward the open and closed positions, thereby, requiring a less complicated electronic control system.

DISCLOSURE OF THE INVENTION

In one aspect of the present invention, a valve actuation system is adapted for use with an internal combustion engine. The internal combustion engine has a cylinder head and a valve disposed within the cylinder head. The valve has an open and closed position. The valve actuation system includes an actuator head with a bore therein connected to the cylinder head and a cylindrical body adapted for connection within the bore in the actuator head. The body has an axially extending bore therethrough. A plunger is operatively associated with the valve and has a plunger surface. The plunger is operatively associated with the cylinder head to define a plunger cavity. The plunger is slidably disposed partially within the bore in the body and is movable between a first position and a second position. A source of relatively high pressure fluid and a source of relatively low pressure fluid are included within the valve actuation system. Means biasing the plunger toward the first position. A first means selectively communicates fluid from the high pressure source into the plunger cavity for urging the plunger toward the second position so that the valve is moved to the open position. A second means selectively communicates fluid exhausted from the plunger cavity to the low pressure source in response to the biasing means urging the plunger toward the first position so that the valve is moved to the closed position. Hydraulic means reduces the plunger velocity as the valve approaches the open and closed positions.

In another aspect of the present invention, an internal combustion engine has a cylinder head and a valve disposed within the cylinder head. The valve has an open and a closed position. An actuator head with a bore therein is connected to the cylinder head. A cylindrical body is connected within the bore in the actuator head. The body has an axially extending bore therethrough. A plunger is operatively associated with the valve and has a plunger surface. The plunger is operatively associated with the cylinder head to define a plunger cavity. The plunger is slidably disposed partially within the bore in the body and is movable between a first position and a second position. A source of relatively high pressure fluid and a source of relatively low pressure fluid are included within the valve actuation system. Means biasing the plunger toward the first position. A first means selectively communicates fluid from the high pressure source into the plunger cavity for urging the plunger toward the second position so that the valve is moved to the open position. A second means selectively communicates fluid exhausted from the plunger cavity to the low pressure source in response to the biasing means urging the plunger toward the first position so that the valve is moved to the closed position. Hydraulic means reduces the plunger velocity as the valve approaches the open and closed positions.

The present invention, through the use of hydraulic means for reducing the plunger velocity during the opening and closing of the valve, provides a simple method for controlling the valve lift and valve seating velocity. The present invention reduces the complexity of the electronic system for controlling velocity and is therefore dependable.

BEST MODE FOR CARRYING OUT THE INVENTION

Figure 1:
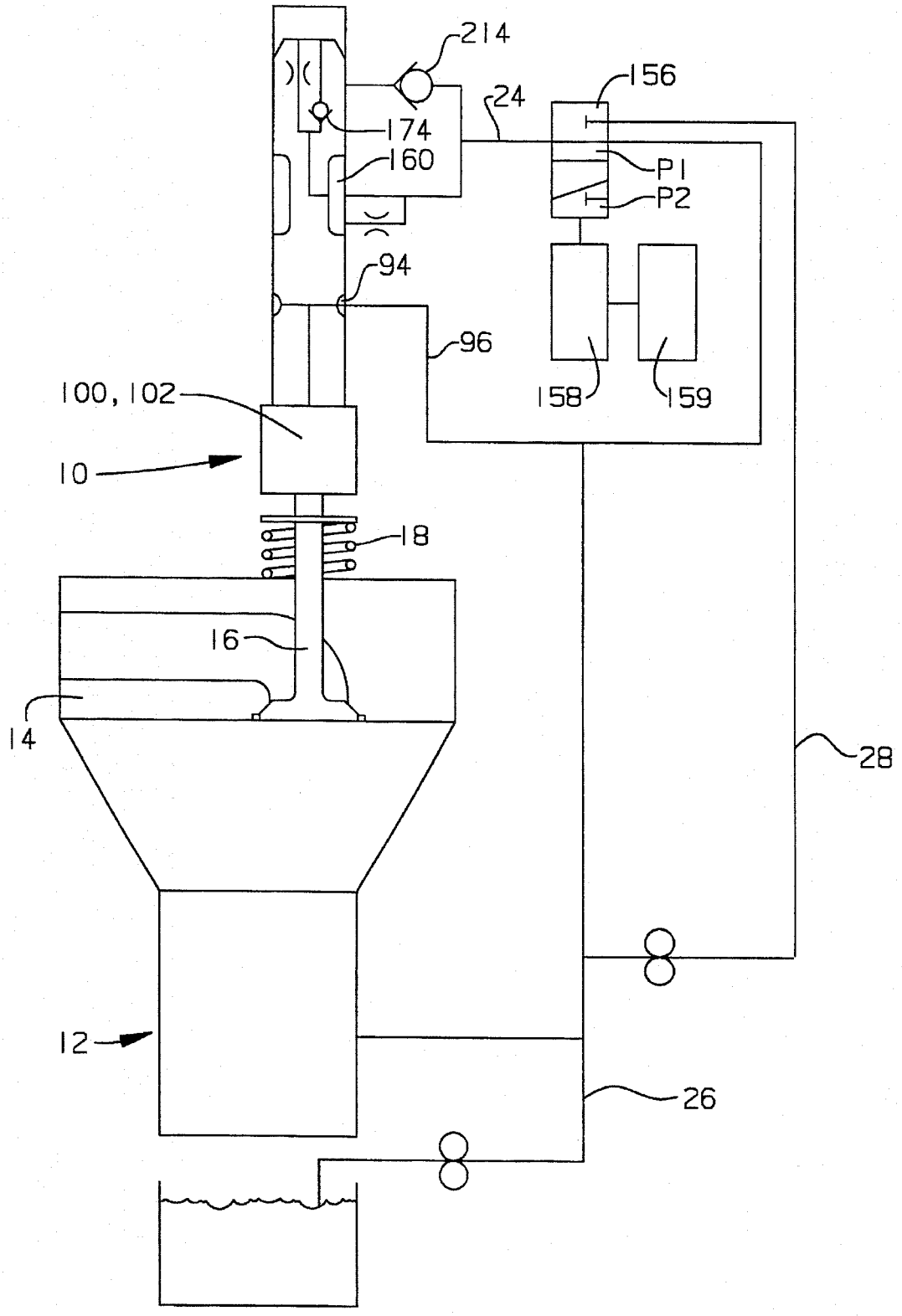
FIG. 1 is a diagrammatic view of a valve actuation system.
Figure 2:
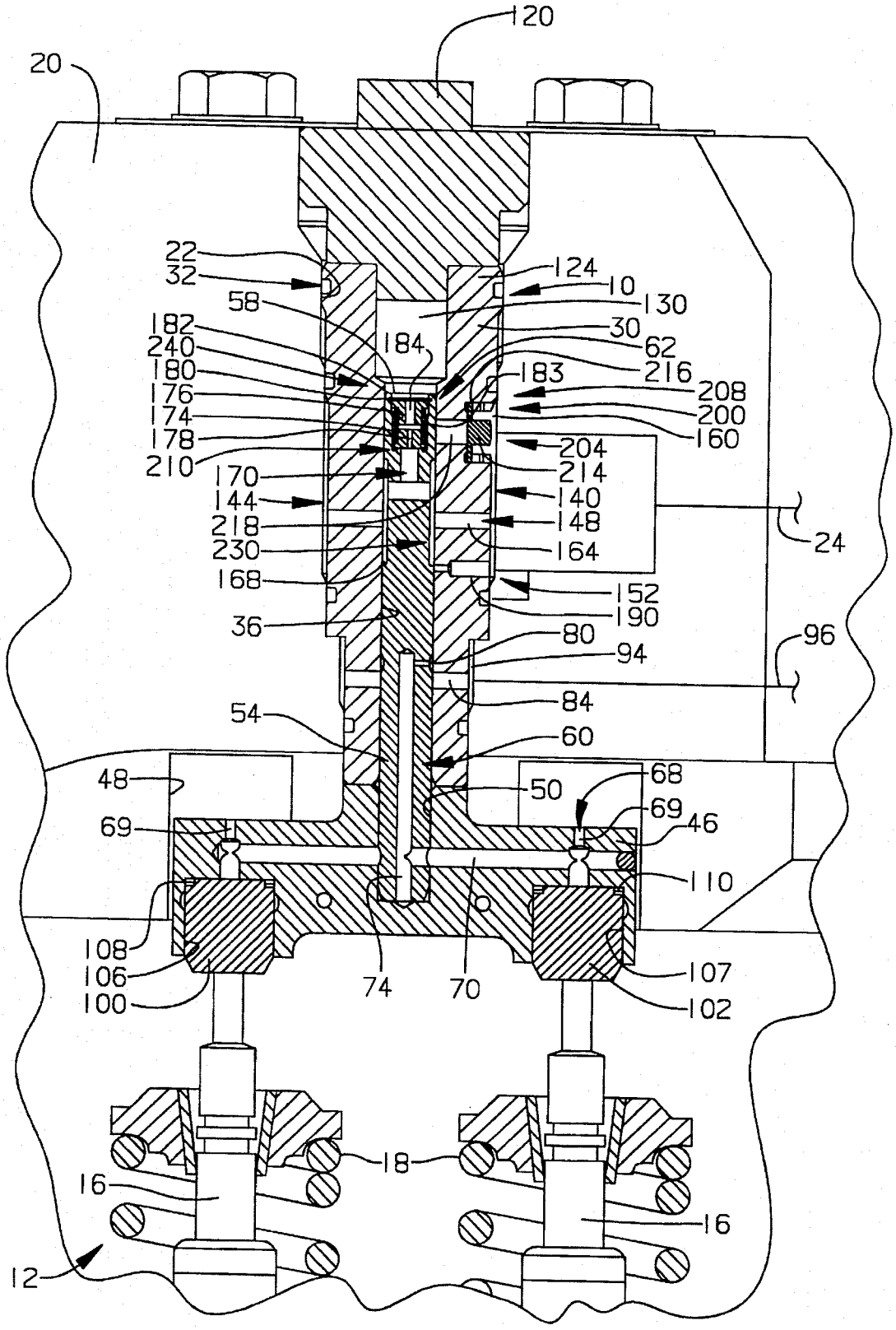
FIG. 2 is a diagrammatic partial section view of the valve actuation system of FIG. 1 showing the valve in the closed position.
Figure 3:
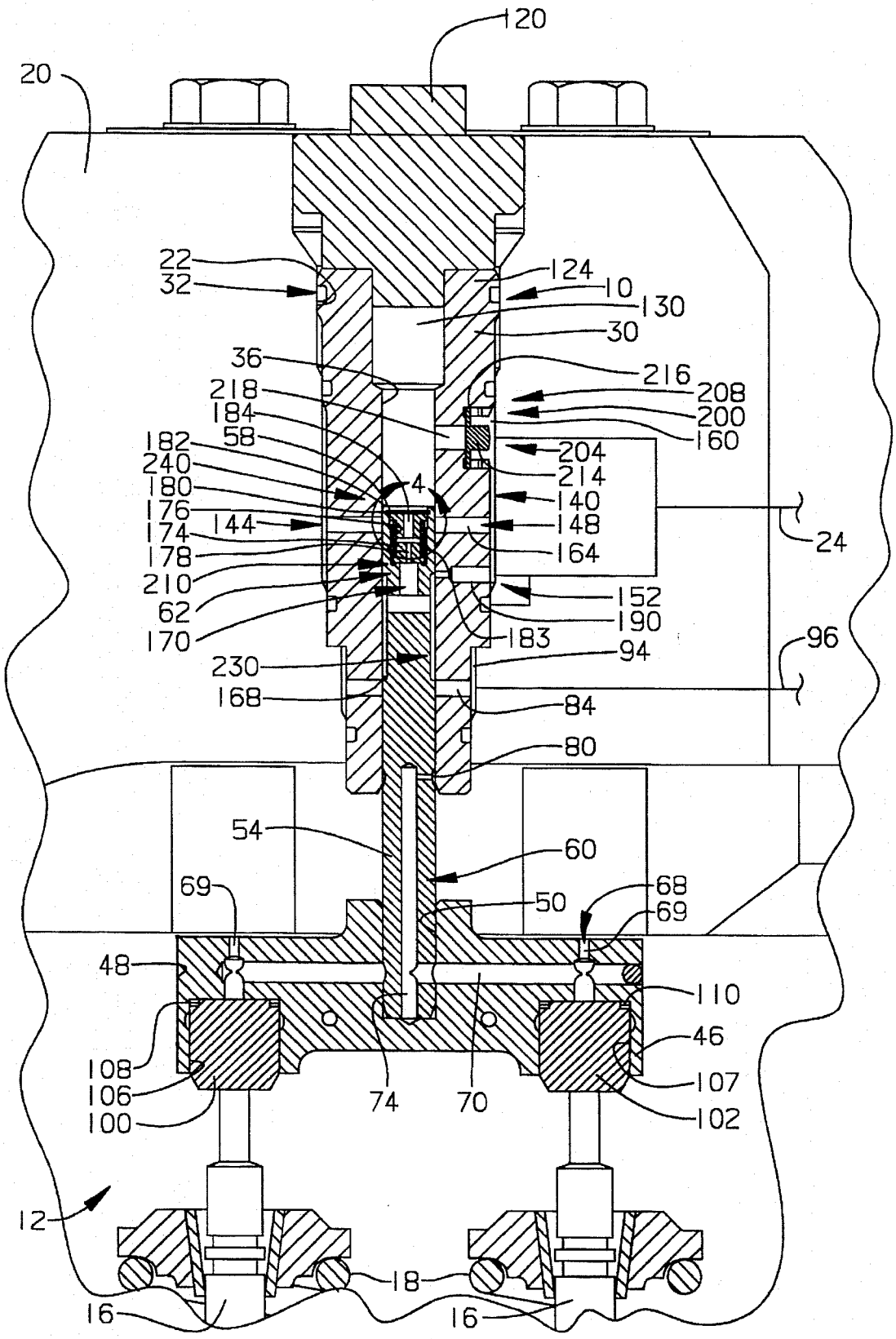
FIG. 3 is a diagrammatic partial section view of the valve actuation system of FIG. 1 showing the valve in an open position; 10

A valve actuation system 10 for an internal combustion engine 12 is shown in FIGS. 1–3. The engine 12 has a cylinder head 14 and one or more engine valve(s) 16 reciprocally disposed within the cylinder head 14. The engine valves 16 are only partially shown in FIGS. 1–3 and may, for example, be a set of conventional exhaust or intake poppet valves. The valves 16 are each displaceable between a first closed position, shown partially in FIG. 2, and a second open position, shown partially in FIG. 3. The valves 16 are biased toward the first position by any suitable means, such as by helical compression springs 18. It should be understood that the internal combustion engine 12 could be a multi-stroke cycle or any suitable stroke cycle engine. For purposes of clarification the engine 12 will be further described as having only a single cylinder, however, it should be understood that the valve actuation system would function as intended in a multiple cylinder engine.

Detailed views of the internal components within the valve actuation system 10 are shown in FIGS. 2–3. The actuator head 20 has a axially extending bore 22 therethrough of varying diameters. Additionally, the actuator head 20 has a rail passage 24 therein selectively communicating between a low pressure fluid source 26 and a high pressure fluid source 28, as shown more clearly in FIG. 1.

Figure 4:
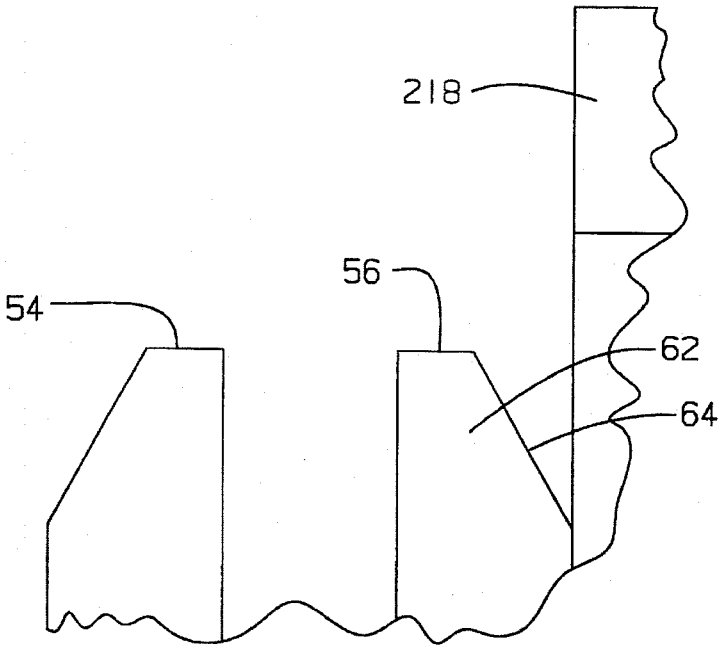
FIG. 4 is an exaggerated enlarged detail view encircled by 4—4 of FIG. 3.

The fluid pressure of the fluid from the high pressure fluid source 26 is preferably greater than 1500 psi, and more preferably greater than 3000 psi. The fluid pressure of the fluid from the low pressure fluid source is preferably less than 400 psi, and more preferably, less than 200 psi. A cylindrical body 30 is sealingly fitted within the bore 22 by a plurality of o-rings 32 and has an axially extending bore 36. However, any suitable connection or sealing means may be used to fit the body 30 within the bore 22. A bridge 46 of any suitable type is disposed within a groove 48 in the actuator head 20 and is adjacent the body 30. The bridge 46 has a bore 50 with a predetermined length which is coaxially aligned with the bore 36 in the body 30. A plunger 54 with a plunger surface 58 is securely fitted within the bore 50 of the bridge 46 at an end 60 with a portion of the plunger 54 slidably disposed within the bore 36 of the body 30 at an opposite end 62. The opposite end 62 of the plunger 54 has a frusto-conical shape 64 which diverges from plunger surface 58 at a predetermined angle which can be seen in more detail in FIG. 4. The plunger 54 may be integrally formed with or separately connected to the bridge 46, such as by press fitting. The plunger 54 is operatively associated with the valves 16 and is movable between a first position and a second position. The movement of the plunger 54 toward the second position moves the valves 16 to their open position. The plunger 54 is biased to the first position by the helical springs 18. It should be understood that the plunger 54 may be used to directly actuate the engine valves 16 without the use of a bridge 46. In this manner, the plunger 54 would be integrally formed with or separately positioned adjacent the engine valves 16.

A means 68 for communicating low pressure fluid into the bridge 46 is provided in close proximity to end 60. The communicating means 68 includes a pair of orifices 69 disposed within the bridge 46 and a pair of connecting passages 70 extending through the orifices 69 and the bridge 46 and into the plunger 54. A longitudinal bore 74 extends a predetermined distance into the plunger 54 and is in fluid communication with the connecting passages 70 within the bridge 46. An orificed passage 80 extends outwardly from the longitudinal bore 74. A cross bore 84 extends through the body 30 at a lower end 90 in close proximity to the end 60 of the plunger 54. The cross bore 84 is connected to a lower annular cavity 94 defined between the body 30 and the actuator head 20 for fluid communication therewith. The lower annular cavity 94 is in communication with the low pressure fluid source 26 through a passage 96 connected to the rail 24 in the actuator head 20. The cross bore 84 has a predetermined position relative to the orificed passage 80. A pair of hydraulic lash adjustors 100,102 are secured within a pair of large bores 106,107, respectively, in the bridge 46 by any suitable means, such as a pair of retaining rings 108,110. The lash adjustors 100,102 are in fluid communication with the orifices 69 and the connecting passages 70 and are adjacent the engine valves 16. However, it should be understood that the lash adjustors 100, 102 may or may not have the orifices 69 dependent upon the internal design used.

A plug 120 is connected to the actuator head 20 and is sealingly fitted into the bore 50 at an upper end 124 of the body 30 in any suitable manner, such as by threading or press fitting. A plunger cavity 130 is formed within the bore 50 between the plug 120 and the plunger surface 58. It should be understood that although a plug 120 is shown fitted within the bore 50 to define the plunger cavity 130, the cylinder head 14 may be sealingly fitted against the bore 50. Therefore, the plunger cavity 130 would be defined between the cylinder head 14 and the plunger surface 58.

A first means 140 for selectively communicating fluid from the high pressure fluid source into the plunger cavity 130 is provided for urging the plunger 54 toward the second position. The first communicating means 140 includes means 144 defining a primary flow path 148 between the high pressure fluid source and the plunger cavity 130 during initial movement toward the second position. The means 144 further defines a secondary flow path 152 between the high pressure fluid source and the plunger cavity 130 during terminal movement toward the second position. A control valve, preferably a spool valve 156, communicates fluid through the high pressure rail passage 24 and into the primary and secondary flow path 148,152. The spool valve 156 is biased to a first position by a pair of helical compression springs (not shown) and moved against the force of the springs (not shown) to a second position by an actuator 158. The actuator 158 may be of any suitable type, however, in this embodiment the actuator 158 is a piezoelectric motor. The piezoelectric motor 158 is driven by a control unit 159 which has a conventional on/off voltage pattern.

The primary flow path 148 of the first communication means includes an annular chamber 160 defined between the body 30 and the actuator head 20. A main port 164 is defined within the body 30 in fluid communication with the annular chamber 160 and has a predetermined diameter. An annular cavity 168 is defined between the plunger 54 and the body 30 and has a predetermined length and a predetermined position relative to the main port 164. The annular cavity 168 is in fluid communication with the main port 164 during a portion of the plunger 54 movement between the first and second positions. A passageway 170 is disposed within the plunger 54 and partially transverses the annular cavity 168 for fluid communication therewith. A first check valve 174 is seated within a bore 176 in the plunger 54 and has an orifice 178 therein in fluid communication with the passageway 170. The first check valve 174 has an open position and a closed position and the orifice 178 has a predetermined diameter. A stop 180 is seated within another bore 182 in the plunger 54 and is disposed a predetermined distance from the first check valve 174. The stop 180 has an axially extending bore 184 for fluidly communicating the orifice 178 with the plunger cavity 130 and a relieved outside diameter. A return spring 183 is disposed within the first check valve 174 between the valve 174 and the stop 180.

The secondary flow path 152 of the first communicating means 140 includes a restricted port 190 which has a diameter less than the diameter of the main port 164. The restricted port 190 fluidly connects the annular chamber 160 to the annular cavity 168 during a portion of the plunger 54 movement between the first and second positions.

A second means 200 for selectively communicating fluid exhausted from the plunger cavity 130 to the low pressure fluid source 26 in response to the helical springs 18 is provided for urging the plunger 54 toward the first position. The second communicating means 200 includes means 204 defining a primary flow path 208 between the plunger cavity 130 and the low pressure fluid source 26 during initial movement from the second position toward the first position. The means 144 further defines a secondary flow path 210 between the plunger cavity 130 and the low pressure fluid source 26 during terminal movement from the second position toward the first position. The spool valve 156 selectively communicates fluid through the primary and secondary flow path 208,210 and into the low pressure rail.

The primary flow path 208 of the second communicating means 200 includes a second check valve 214 seated within a bore 216 in the body 30 with a portion of the second check valve 214 extending into the annular chamber 160. The second check valve 214 has an open and a closed position. A small conical shaped return spring (not shown) is disposed within the second check valve 214. An outlet passage 218 is defined within the body 30 between the second check valve 214 and the plunger 54. The outlet passage 218 provides fluid communication between the plunger cavity 130 and the annular chamber 160 when the second check valve is in the open position during a portion of the plunger 54 movement between the second and the first position.

The secondary flow path 210 of the second communicating means 200 includes the orifice 178 being fluidly connected to the low pressure source 26 during a portion of the plunger 54 movement between the second and first positions.

A first hydraulic means 230 is provided for reducing the plunger 54 velocity as the valves 16 approach the open position. The first hydraulic means 230 includes restricting fluid communication to the annular cavity 168 from the high pressure fluid source 28 through the main port 164 during a portion of the plunger 54 movement between the first and second positions and blocking fluid communication to the annular cavity 168 from the high pressure fluid source 28 through the main port 164 during a separate portion of the plunger 54 movement between the first and second positions. A second hydraulic means 240 is provided for reducing the plunger 54 velocity as the valves 16 approach the closed position. The second hydraulic means 240 includes the frusto-conical shaped end 62 of the plunger 54 restricting fluid communication to the low pressure fluid source 26 from the plunger cavity 168 through the outlet passage 218 and blocking fluid communication to the low pressure fluid source 26 from the plunger cavity 168 through the outlet passage 218.

INDUSTRIAL APPLICABILITY

For increased understanding, the following sequence begins with the plunger 54 in the first position, and therefore, the valve in the closed (or seated) position. Referring to FIG. 1, to begin the valve opening sequence, voltage from the control unit is sent to the piezoelectric motor 158 which, in turn, drives the spool valve 156 in a known manner from the first position P1 to the second position P2. Movement of the spool valve 156 from the first position P1 to the second position P2 closes off communication between the low pressure fluid source 26 and the plunger cavity 130 and opens communication between the high pressure fluid source 28 and the plunger cavity 130.

Referring more specifically to FIG. 2, during the initial portion of the plunger 54 movement from the first position to the second position, high pressure fluid from the high pressure fluid source 28 is communicated to the plunger cavity 130 through the primary flow path 148. The high pressure fluid unseats the first check valve 174 allowing the majority of high pressure fluid to enter the plunger cavity 130 around the first check valve 174 through the relieved outside diameter of the stop 180 at a rapid rate.

As the plunger cavity 130 fills with high pressure fluid, the plunger 54 moves rapidly downward opening the valves 16 against the force of the springs 18. As the plunger 54 moves downward, the position of the annular cavity 168 in relation to the main port 164 is constantly changing. The downward motion of the annular cavity 168 allows fluid connection between the annular cavity 168 and the restricted port 190, thereby allowing high pressure fluid to enter the plunger cavity 130 through both the primary and secondary flow paths 148,152.

As the annular cavity 168 moves past the main port 164 in the terminal portion of the plunger movement, as can be seen in FIG. 3, fluid communication is restricted and eventually blocked by the outer periphery of the plunger 54 so that all fluid communication between the high pressure fluid source 28 and the plunger cavity 130 is through the restricted port 190. Since the diameter of the restricted port 190 is smaller than the main port 174, downward motion of the plunger 54 is slowed, thereby, reducing the velocity of the valve 16 as it reaches it full open position.

As the annular cavity 168 moves past the restricted port 190, fluid communication is restricted and eventually blocked by the outer periphery of the plunger 54 which allows the plunger 54 to hold the valve 16 at its maximum lift position. As leakage occurs within the system, the plunger 54 will move up and slightly re-open the restricted port 190 and, therefore, recharge the plunger cavity 130 causing the plunger 54 to move back down. The valve 16 open position is then stabilized around the maximum lift position by the small movements of the plunger 54 opening and closing the restricted port 190. During this time, the return spring 183 on the first check valve 174 returns the valve 174 to its seat. It should be understood that the restricted port 190 may not be necessary dependent upon specific designs which would accomplish rapid stopping of the plunger 54 at maximum lift, such as utilizing a plunger 54 with a larger diameter or higher forces on the springs 18.

Referring again to FIG. 1, to begin the valve closing sequence, voltage from the control unit is removed from the piezoelectric motor 158 which, in turn, allows the spool valve 156 to return in a known manner from the second position P2 to the first position P1. Movement of the spool valve 156 from the second position P2 to the first position P1 closes off communication between the high pressure fluid source 28 and the plunger cavity 130 and opens communication between the low pressure fluid source 26 and the plunger cavity 130. At this stage, the potential energy of the springs 18 is turned into kinetic energy in the upwardly moving engine valve 16.

Referring more specifically to FIG. 3, the high pressure fluid within the plunger cavity 130 unseats the second check valve 214 since low pressure fluid is now within the annular chamber 160. The unseating of the second check valve 214 allows the majority of fluid within the plunger cavity 130 to rapidly return to the low pressure fluid source 26 through the primary flow path 208. A portion of the high pressure fluid within the plunger cavity 130 is returned to the low pressure fluid source 26 through the secondary flow path as the orifice 178 fluidly connects with the annular chamber 160 during the terminal plunger movement from the second position to the first position.

As the end 62 of the plunger 54 having the frusto-conical shape 64 moves past the outlet passage 218, fluid communication to the low pressure fluid source 26 is gradually restricted and eventually blocked reducing the velocity of the valve 16 as it reaches its closed or seated position. Once the outlet passage 218 is completely blocked, fluid communication from the plunger cavity 130 to the low pressure fluid source 26 is only through the orifice 178, as can be seen in FIG. 2. The fluid communication occurs only through the orifice 178 because the first check valve 174 is seated, allowing substantially no additional fluid communication to around the first check valve 174. Therefore, final seating velocity is more finely controlled by the size of the small diameter of the orifice 178.

Additionally, when the spool valve 156 is in the P1 position and connected with the low pressure fluid source 26, fluid is communicated to the hydraulic adjustors 100,102 through the orifices 69. The orifices 69 communicate with the passages 70 to control the maximum pressure allowed for the lash adjustors 100,102. However, when the spool valve moves into the P2 position, the plunger 54 is moved downwards and the orificed passage 80 moves past the cross bore 84 restricting and eventually blocking fluid communication form the low pressure fluid source 26 to the adjustors 100,102.

Figure 5:
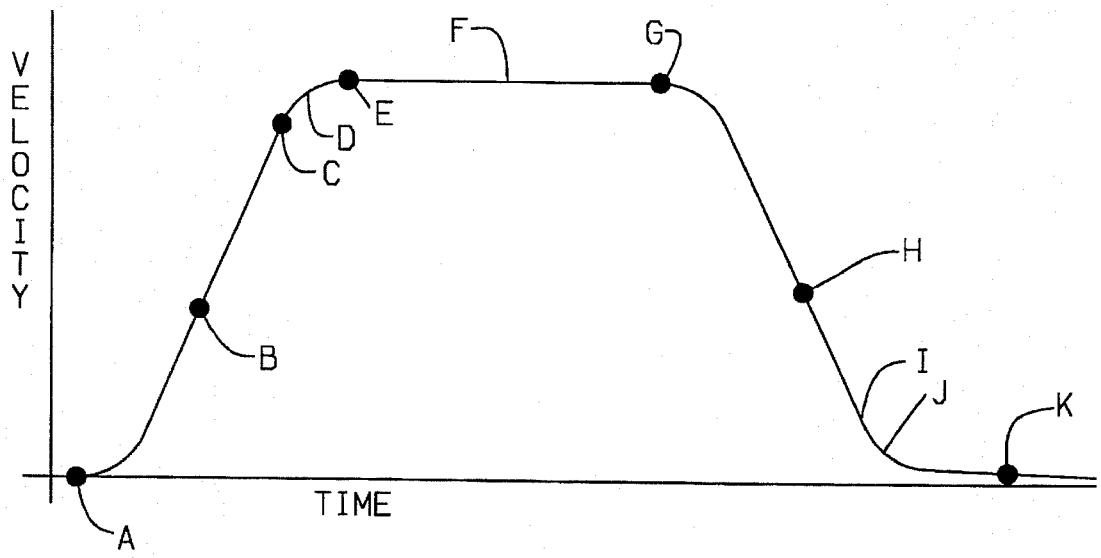
FIG. 5 is a diagrammatic graph showing the valve lift curve for the valve actuation system.

FIG. 5 shows the optimized valve lift curve related to the design of the present invention. Point A is related to the initial control signal to the spool valve 156 moving the spool valve 156 from P1 to P2. Point B is relates to the first check valve 174 unseating and resulting in rapid valve 16 opening. Point C is related to the blocking of the main bore 164. Curve D is related to the limiting the fluid communication to the plunger cavity 130 through the restricted port 190. Point E is related to the blocking of the restricted port 190. Line F is related to the maximum valve lift. Point G is related to the terminal control signal to the spool valve 156 moving the spool valve 156 from P2 to P1. Point H is related to the rapid discharge through the second check valve 214. Curves I&J are related to the frusto-conical end 62 of the plunger 54 restricting fluid communication from the plunger cavity 130 through the outlet passage 218. Point K relates to the fine velocity control achieved through blocking the fluid communication from the plunger cavity 130 through the outlet passage 218 so that all fluid communication from the plunger cavity 130 to the low pressure fluid source 26 is through the orifice 178.

In view of the above, the use of hydraulic means for reducing the plunger velocity during the opening and closing of the valve, provides a simple method for controlling the valve lift and valve seating. The present invention does not rely on expensive or complicated electronic systems for controlling velocity and is therefore more dependable.

We claim:

1. A valve actuation system adapted for use with an internal combustion engine having a cylinder head and a valve disposed within the cylinder head, the valve having an open and a closed position, comprising:

an actuator head with a bore therein connected to the cylinder head;

a cylindrical body adapted for connection within the bore in the actuator head, the body having an axially extending bore therethrough;

a plunger operatively associated with the valve and having a plunger surface, the plunger operatively associated with the cylinder head to define a plunger cavity and being slidably disposed partially within the bore in the body and being movable between a first position and a second position to define a plunger cavity;

a source of relatively high pressure fluid;

a source of relatively low pressure fluid;

means for biasing the plunger towards the first position;

first means for selectively communicating fluid from the high pressure source into the plunger cavity for urging the plunger toward the second position so that the valve is moved to the open position;

second means for selectively communicating fluid exhausted from the plunger cavity to the low pressure source in response to the biasing means urging the plunger toward the first position so that the valve is moved to the closed position; and hydraulic means for reducing the plunger velocity as the valve approaches the open and closed positions.

2. The valve actuation system of claim 1, wherein the first communication means includes means defining a primary flow path between the high pressure source and the plunger cavity during initial movement toward the second position and a secondary flow path between the high pressure source and the plunger cavity during terminal movement toward the second position.

3. The valve actuation system of claim 2, wherein the second communication means includes means defining a primary flow path between the plunger cavity and the low pressure source during initial movement from the second position toward the first position and a secondary flow path between the plunger cavity and the low pressure source during terminal movement from the second position toward the first position.

4. The valve actuation system of claim 3, wherein the primary flow path of the first communication means includes an annular chamber defined between the actuator head and the body and a main port having a predetermined diameter defined within the body in fluid connection with the annular chamber.

5. The valve actuation system of claim 4, wherein the primary flow path of the first communication means includes an annular cavity having a predetermined length and a predetermined position in relation to the main port, the annular cavity being defined between the plunger and the body in fluid connection with the main port during a portion of the plunger movement between the first and second positions.

6. The valve actuation system of claim 5, wherein the primary flow path of the first communication means includes a passageway disposed within the plunger partially traversing the annular cavity for fluid connection therewith.

7. The valve actuation system of claim 6, wherein the primary flow path of the first communication means includes a first check valve seated within a bore in the plunger and a orifice therein in fluid connection with the passageway, the first check valve having an open position permitting a substantially unrestricted flow path in one direction and a closed position permitting a substantially restricted flow path in an opposite direction.

8. The valve actuation system of claim 7, wherein the primary flow path of the first communication means includes a stop disposed a predetermined distance from the first check valve, the stop having an axially extending bore for fluidly connecting the orifice in the first check valve with the plunger cavity.

9. The valve actuation system of claim 8, wherein the orifice in the first check valve has a predetermined diameter.

10. The valve actuation system of claim 8, wherein the secondary flow path of the first communication means includes a restricted port having a diameter less than the diameter of the main port, the restricted port fluidly connects the annular chamber to the annular cavity during a portion of the plunger movement between the first and second positions.

11. The valve actuation system of claim 10, wherein the primary flow path of the second communicating means includes a second check valve disposed within the body and seated within a portion of the annular chamber and an outlet passage disposed between the plunger cavity and the annular chamber via the second check valve for fluid communication therebetween during a portion of the plunger movement between the second and first positions.

12. The valve actuation system of claim 11, wherein the secondary flow path of the second communication means includes the orifice within the first check valve fluidly connected to the low pressure source during a portion of the plunger movement between the second and first positions.

13. The valve actuation system of claim 12, wherein the hydraulic means for reducing the plunger velocity as the valve approaches the open position includes restricting fluid communication to the annular cavity from the high pressure source through the main port.

14. The valve actuation system of claim 12, wherein the hydraulic means for reducing the plunger velocity as the valve approaches the open position includes blocking fluid communication to the annular cavity from the annular chamber through the main port.

15. The actuation system of claim 14, wherein the valve reaches the maximum open position when fluid communication is blocked to the annular cavity from the annular chamber through the restricted port.

16. The valve actuation system of claim 15, wherein the hydraulic means for reducing the plunger velocity as the valve approaches the closed position includes the plunger having a frusto-conical end for restricting the fluid communication to the low pressure source from the plunger cavity through the outlet passage.

17. The valve actuation system of claim 16, wherein the hydraulic means for reducing the plunger velocity as the valve approaches the closed position includes blocking the fluid communication to the low pressure source from the plunger cavity through the outlet passage.

18. An internal combustion engine having a cylinder head and a valve disposed within the cylinder head, the valve having an open and a closed position, comprising:

an actuator head with a bore therein connected to the cylinder head;

a cylindrical body connected within the bore in the actuator head, the body having an axially extending bore therethrough;

a plunger operatively associated with the valve and having a plunger surface, the plunger operatively associated with the cylinder head to define a plunger cavity and being slidably disposed partially within the bore in the body and being movable between a first position and a second position;

a source of relatively high pressure fluid;

a source of relatively low pressure fluid;

means for biasing the plunger towards the first position;

first means for selectively communicating fluid from the high pressure source into the plunger cavity for urging the plunger toward the second position so that the valve is moved to the open position;

second means for selectively communicating fluid exhausted from the plunger cavity to the low pressure source in response to the biasing means urging the plunger toward the first position so that the valve is moved to the closed position; and hydraulic means for reducing the plunger velocity as the valve approaches the open and closed positions.

19. The valve actuation system of claim 18, wherein the first communication means includes means defining a primary flow path between the high pressure source and the plunger cavity during initial movement toward the second position and a secondary flow path between the high pressure source and the plunger cavity during terminal movement toward the second position.

20. The engine of claim 19, wherein the second communication means includes means defining a primary flow path between the plunger cavity and the low pressure source during initial movement from the second position toward the first position and a secondary flow path between the plunger cavity and the low pressure source during terminal movement from the second position toward the first position.

21. The engine of claim 20, wherein the primary flow path of the first communication means includes an annular chamber defined between the actuator head and the body and a main port having a predetermined diameter defined within the body in fluid connection with the annular chamber.

22. The engine of claim 21, wherein the primary flow path of the first communication means includes an annular cavity having a predetermined length and a predetermined position in relation to the main port, the annular cavity being defined between the plunger and the body in fluid connection with the main port during a portion of the plunger movement between the first and second positions.

23. The engine of claim 22, wherein the primary flow path of the first communication means includes a passageway disposed within the plunger partially traversing the annular cavity for fluid connection therewith.

24. The engine of claim 23, wherein the primary flow path of the first communication means includes a first check valve seated within a bore in the plunger and a orifice therein in fluid connection with the passageway, the first check valve having an open position permitting a substantially unrestricted flow path in one direction and a closed position permitting a substantially restricted flow path in an opposite direction.

25. The engine of claim 24, wherein the primary flow path of the first communication means includes a stop disposed a predetermined distance from the first check valve, the stop having an axially extending bore for fluidly connecting the orifice in the first check valve with the plunger cavity.

26. The engine of claim 25, wherein the orifice in the first check valve has a predetermined diameter.

27. The engine of claim 25, wherein the secondary flow path of the first communication means includes a restricted port having a diameter less than the diameter of the main port, the restricted port fluidly connects the annular chamber to the annular cavity during a portion of the plunger movement between the first and second positions.

28. The engine of claim 27, wherein the primary flow path of the second communicating means includes a second check valve disposed within the body and seated within a portion of the annular chamber and an outlet passage disposed between the plunger cavity and the annular chamber via the second check valve for fluid communication therebetween during a portion of the plunger movement between the second and first positions.

29. The engine of claim 28, wherein the secondary flow path of the second communication means includes the orifice within the first check valve fluidly connected to the low pressure source during a portion of the plunger movement between the second and first positions.

30. The engine of claim 29, wherein the hydraulic means for reducing the plunger velocity as the valve approaches the open position includes restricting fluid communication to the annular cavity from the high pressure source through the main port.

31. The engine of claim 29, wherein the hydraulic means for reducing the plunger velocity as the valve approaches the open position includes blocking fluid communication to the annular cavity from the annular chamber through the main port.

32. The engine of claim 31, wherein the valve reaches the maximum open position when fluid communication is blocked to the annular cavity from the annular chamber through the restricted port.

33. The engine of claim 32, wherein the hydraulic means for reducing the plunger velocity as the valve approaches the closed position includes the plunger having a frusto-conical end for restricting the fluid communication to the low pressure source from the plunger cavity through the outlet passage.

34. The engine of claim 33, wherein the hydraulic means for reducing the plunger velocity as the valve approaches the closed position includes blocking the fluid communication to the low pressure source from the plunger cavity through the outlet passage.

* * * * *